US005469241A

United States Patent [19]

Takahashi et al.

[11] Patent Number: 5,469,241

[45] Date of Patent: Nov. 21, 1995

[54] MICROFILM CAMERA

[75] Inventors: Yutaka Takahashi; Shinichi Shidara, both of Tokyo, Japan

[73] Assignee: Fuji Photo Film Co., Ltd., Kanagawa, Japan

[21] Appl. No.: 47,295

[22] Filed: Apr. 19, 1993

[30] Foreign Application Priority Data

Apr. 17, 1992 [JP] Japan ..... 4-124256

[51] Int. Cl.[6] ..... B06K 7/10

[52] U.S. Cl. ..... 355/64; 355/40; 355/41; 235/379

[58] Field of Search ..... 355/40, 41, 64, 355/65; 235/379

[56] References Cited

U.S. PATENT DOCUMENTS 4,201,978 5/1980 Nally ..... 340/146.3
4,724,309 2/1988 Greene ..... 235/468
4,806,965 2/1989 Yamanouchi ..... 355/1

*Primary Examiner*—Michael L. Gellner
*Assistant Examiner*—Daniel P. Malley
*Attorney, Agent, or Firm*—Sughrue, Mion, Zinn, Macpeak & Seas

[57] ABSTRACT

Improvement in the microfilm camera for reading an amount of money of an addressed bill or check brought into a bank, the amount of money being written in the column for writing the amount of money by the drawer of the addressed bill or check, for printing the read amount of money for magnetic ink character recognition (MICR) and for photographing the image of the addressed bill or check on a microfilm. The improved microfilm camera, provided by the invention, comprises an OCR for reading the amount of money written by the drawer, an MICR printer disposed downstream of the OCR for printing the amount of money read by the OCR, and an optical system for photographing the image of the addressed bill or check on a microfilm after the addressed bill or check is printed for MICR by the MICR printer.

By the use of the improved microfilm camera of the invention, the amount of money written in each bill or check is printed for MICR automatically without the need of manual input operation thereby improving the operation efficiency and diminishing the occurrence of mistakes input operation.

11 Claims, 8 Drawing Sheets

MICROFILM CAMERA

BACKGROUND OF THE INVENTION

1. Field of the Invention

The present invention relates to a microfilm camera for printing the amount of money with a magnetic ink on an addressed bill or check, the amount of money being originally written on the addressed bill or check with an ordinary ink, and for photographing the image of the addressed bill or check on a microfilm.

2. Prior Art

An addressed bill or check is written with an amount of money by the drawer, and then brought to a bank by the payee after being written with the endorsement.

The bank receiving the bill or check sorts the bill or check, prints the amount of money on the bill or check with a magnetic ink, and photographs the image of the bill or check on a microfilm which is stored for recording. The bill or check is transferred to the exchange center for exchanging bills and checks to be distributed to the designated bank so that the amount of money of the bill or check is pulled down from the bank account in the designated bank.

In order to read the amount of money and sort of each addressed bill or check in an automated system, the amount of money and characters identifying the bill or check are printed with a magnetic ink. The recognition of characters printed with a magnetic ink is referred to as magnetic ink character recognition and will be abridged as MICR throughout the specification and appended claims.

The data, other than the amount of money, including the sort and other information is printed by MICR through an MICR printer at the time of issuance of the bills or checks. Such data include, for example, the sort of the bill or check, the discrimination mark for discriminating whether the bill or check is issued from the same bank or another bank, the code number of the bank, the classification mark to identify the sort of the bill, such as payment bill, commercial bill or mortgage bill, the name or code number of the bill exchange center, the branch code number and date.

Since the amount of money is written at the time when the bill or check is drawn, the amount of money must be printed for MICR by the bank to which the bill or check is brought. In the conventional system, MICR printing of the amount of money is instructed manually by an operator through a keyboard. The operator reads the amount of money written in the column for identifying the amount of money, and inputs the amount of money by typewriting the numeral keys on the keyboard.

FIG. 6 shows a conventional system or microfilm camera for carrying out the MICR printing and microfilm photographing of the bill or check; FIG. 7 is a flow chart showing the processing sequence through which each bill or check is handled; FIG. 8 is an illustration showing a part of the microfilm on which images of bills or checks are photographed; FIG. 9 is a bill before it is drawn; and FIG. 10 is a bill after it is printed for MICR.

A bill or check is issued initially from a bank (Step 100 in FIG. 7). FIG. 9 shows an issued bill A on which data showing the sort of the bill or other necessary information is written. In FIG. 9, a designates a column for writing the number of the bill, b designates a column for writing the name and number of the exchange center, c designates a column for writing the due date for payment, d designates a column for writing the place of payment, e designates a column for writing the domicile of payment, f designates a column for writing the date of drawing, g designates a column for writing the domicile of drawing, and h designates a column for writing the name of drawer. The column for writing the amount of money is denoted by i. The column j is the column for writing the name of drawer.

Amongst these columns a to j, the columns other than c, f, g, h and i have been written with an ordinary ink other than a magnetic ink at the time of issuance of the bill or check from the bank. The columns c, f, g, h and i are filled by writing by the drawer at the drawing of the bill. These columns may be filled by writing with the use of a special instrument, such as a check writer.

Columns k and m for MICR printing are arranged at the lower portion of the bill A. Data relating to the identification of the bill including the sort and other necessary information is printed for MICR in the column k. For instance, the sort of the bill, the number of the exchange center, the name of the bank, the branch name, the account number of the drawer for settling the amount of money and the number of the bill have been written with numeral and symbol characters at the time of issuance of the bill. The column m is a blank column in which the amount of money is to be printed for MICR.

The drawer draws the bill A after writing the amount of money and other necessary information (Step 102). The payee of the thus drawn bill A (see FIG. 9) writes the endorsement (Step 104), and brings the bill to a bank (Step 106). The bank prints, with a magnetic ink, the amount of money written in the column i for MICR in the column m of the bill A using a microfilm camera 1 shown in FIG. 6 (Step 108).

In the microfilm camera 1, a group of bills B which is sorted, for example, as issued from the same bank is conveyed from a feeder 2 for containing the bills through a conveying passage 3 to a stacker 4 one by one. An MICR printer 5, with a magnetic ink, and an optical system 6 are disposed along the conveying passage 3. The MICR printer 5 prints the amount of money in the MICR print column m in response to the instruction from a controller 7 to which the amount of money is inputted through a keyboard 8.

An operator 9 reads the amount of money from the column i of each bill B placed on the feeder 2 to input the amount of money through the numeral keys of the keyboard 8. The controller 7 discriminates the amount of money inputted through the keyboard 8 at the key input discriminating section **7*a* to instruct the MICR printer 5 to carry out MICR printing in the MICR print column m. By this processing, the bill B is processed to the bill C shown in FIG. 10**.

The processed bill C is fed to the optical system 6 where it is photographed on a microfilm 10. The microfilm 10 is supplied from a supply reel 11, and conveyed through a photographing roller 12 to a take-up reel 13. The microfilm 10 moves on the upper half circumference of the photographing roller 12 while in firm contact with the roller 12 on which the images on the obverse and reverse sides of the bill C are focused by the optical system 6. As the result, the images C1 and C2 on the obverse and reverse sides of the bill are photographed side by side with each other as shown in FIG. 8 (Step 110 in FIG. 7).

The controller 7 includes a sorting and totalizing section **7*b* by which the amounts of money inputted through the keyboard 8 are totalized, and the result of totalization is outputted through a printer 14 with other data such as date, names of the banks, etc. The printed output is referred to as a jounal print 15. The journal print 15 is sent to the optical system 6 to be photographed at a predetermined position, for example, at the fore end or aft end of the microfilm 10 (Step 112 in FIG. 7). The photographed image of the journal print 15 is denoted by 15A in FIG. 8**.

However, the prior art microfilm camera has a problem that the amount of money must be inputted manually by the operator, thereby lowering the operation efficiency. In addition, there is a fear of mistake in the manual input operation. Another problem is that the accuracy and operation speed depends on the skillfulness of the operator.

OBJECTS AND SUMMARY OF THE INVENTION

The present invention has been accomplished under the circumstances as described above, and the object thereof is to provide a microfilm camera for obviating the manual operation of printing the amount of money for MICR on an addressed bill or check to improve the operation efficiency and to considerably lessen the occurrence of mistake in input operation.

The object of the invention is attained by the provision of an improved microfilm camera for reading an amount of money of an addressed bill or check brought into a bank, said amount of money being written in the column for writing the amount of money by the drawer of said addressed bill or check, to print the read amount of money for magnetic ink character recognition (MICR) and for photographing the image of said addressed bill or check on a microfilm, the improved microfilm camera comprising an OCR for reading said amount of money written by the drawer, an MICR printer disposed downstream of said OCR for printing the amount of money read by said OCR, and an optical system for photographing the image of said addressed bill or check on a microfilm after said addressed bill or check is printed for MICR by said MICR printer.

When the amount of money cannot be read by the OCR, the addressed bill or check is rejected and discharged from the camera, and then the amount of money is read by the operator and inputted through the keyboard. The bill or check may be discharged before or after it is conveyed through the optical system. When the bill or check is discharged after it is conveyed through the optical system, the image of the bill or check is photographed while the column m to be filled with MICR printing of the amount of money is left blank. However, this causes no inconvenience since another image having the column m filled with appropriate MICR printing by manual operation is photographed at the later time.

An MICR reader may be provided, in addition to OCR, to read the data printed in the column k so that the data relating to the identification of each bill or check is recorded on the microfilm together with the result of totalization of the amounts of money. By the use of such a camera, there is no need of outputting the journal print 15, leading to a further improvement in operation efficiency.

The numeral characters in the column i of the addressed bill or check are read by OCR, and the amount of money is discriminated by the OCR discrimination section and printed in the MICR printing column m by the MICR printer. The image of the bill or check is photographed by the optical system on the microfilm and then the bill or check is discharged to the stacker.

DESCRIPTION OF PREFERRED EMBODIMENTS

Figure 1:
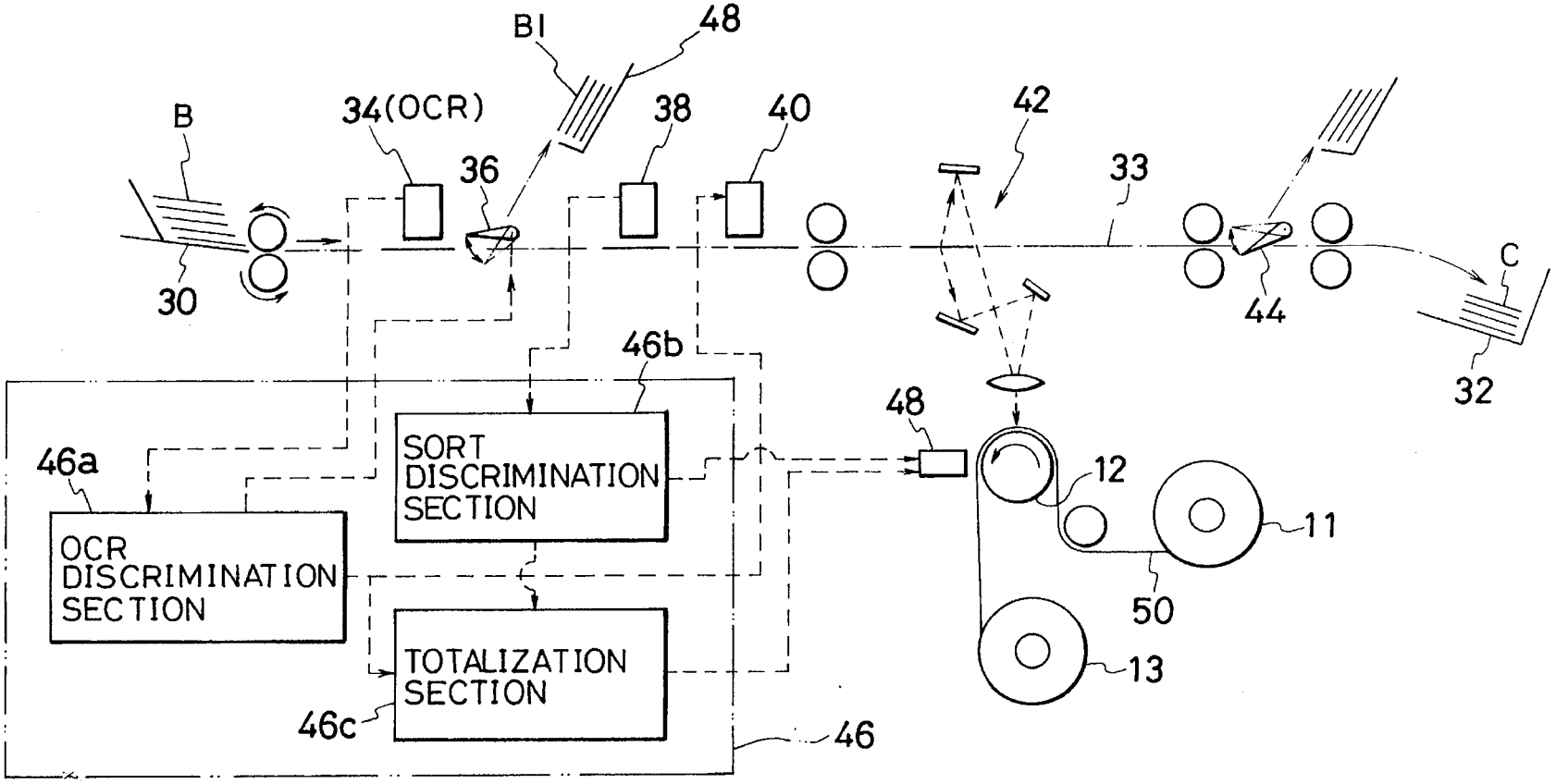
FIG. 1 is a diagrammatical view showing the construction of a first embodiment of the invention.
Figure 2:
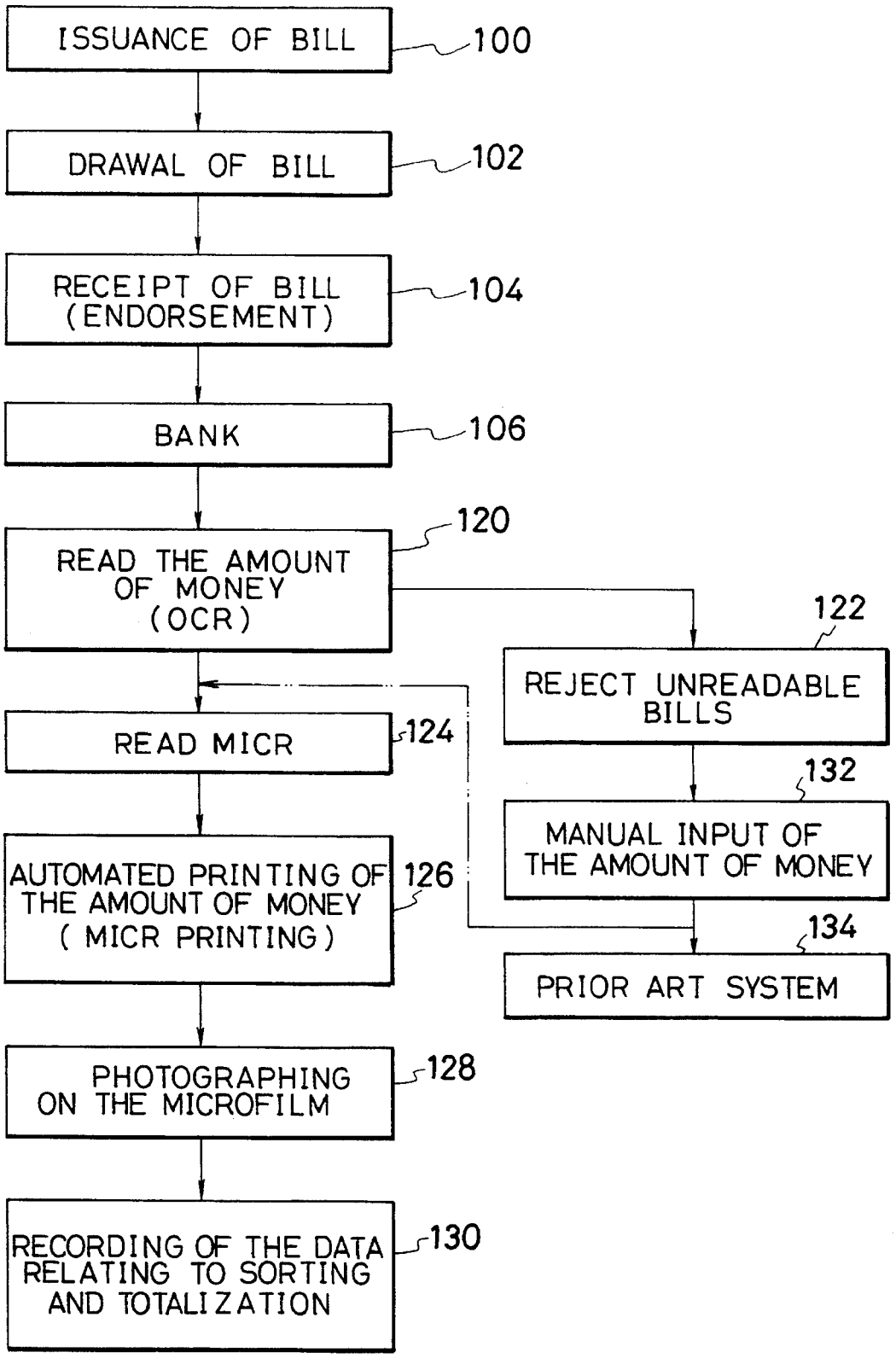
FIG. 2 is a flow chart showing the operation sequence in the first embodiment.

FIG. 1 is a diagrammatical view showing the construction of a first embodiment of the invention; and FIG. 2 is a flow chart showing the operation sequence in the first embodiment. In FIG. 1, reference numeral 30 designates a feeder, reference numeral 32 designates a stacker, and reference numeral 33 designates a passage along which bills or checks are conveyed. Along the passage 33, there are disposed an OCR (optical character reader) 34, a rejecter 36, an MICR reader 38, an MICR printer 40, an optical system 42 and an additional rejector 44.

The OCR 34 is provided to read the numerals and marks in the column i (see FIGS. 9 and 10) for writing the amount of money of a bill B, and the content read by the OCR is discriminated by an OCR discrimination section 46*a* of a controller 46 (Step 120 in FIG. 2). The rejecter 36 has a lever for getting into the passage 33 to discharge a bill B1 when the amount of money of the bill B1 is not discriminated by the OCR discrimination section 46*a*. The thus rejected bills B1 are collected in a stacker 48 (Step 122 in FIG. 2).

Figure 6:
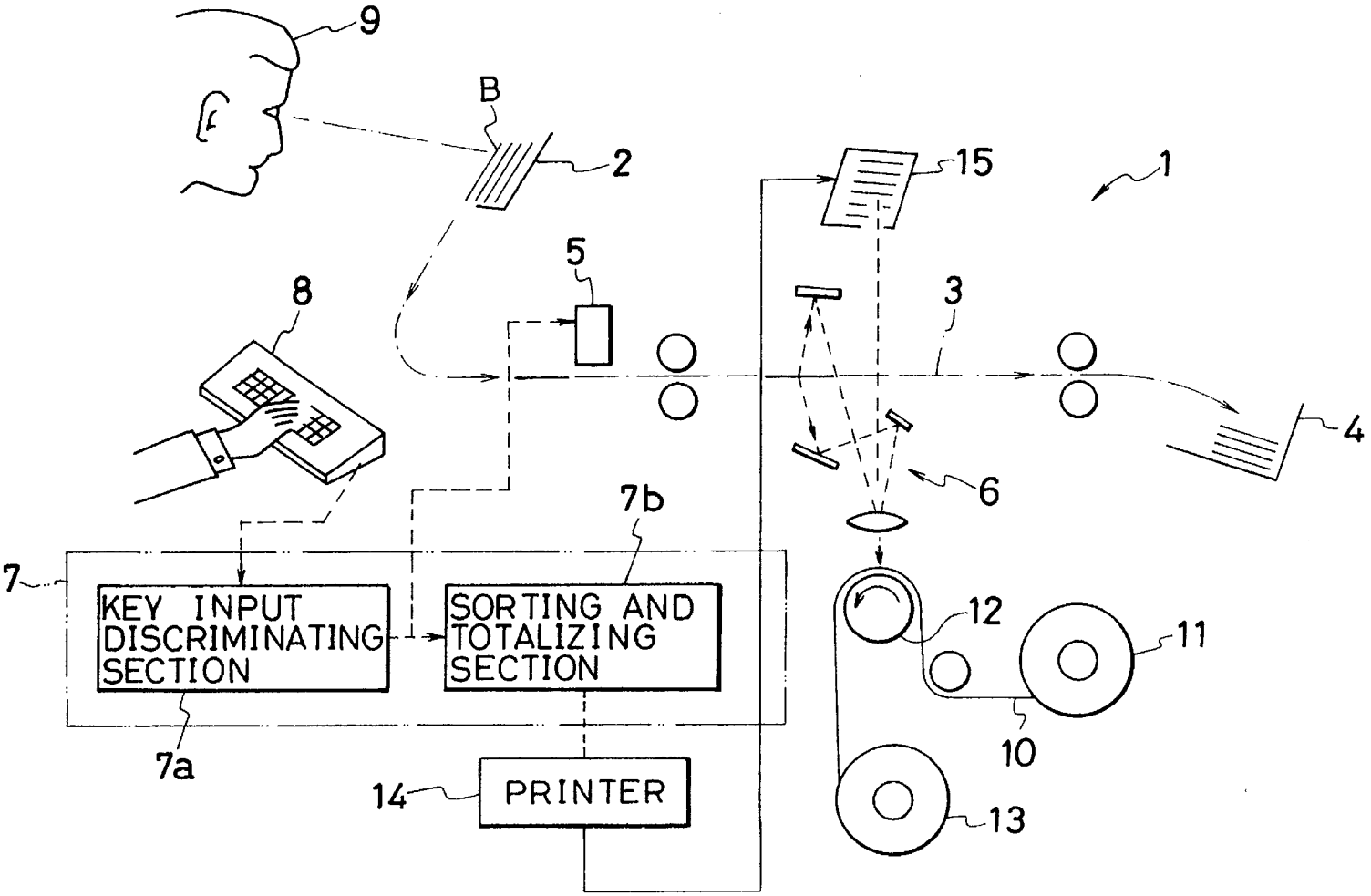
FIG. 6 (PRIOR ART)
FIG. 6 is a diagrammatical view showing a prior art system.
Figure 7:
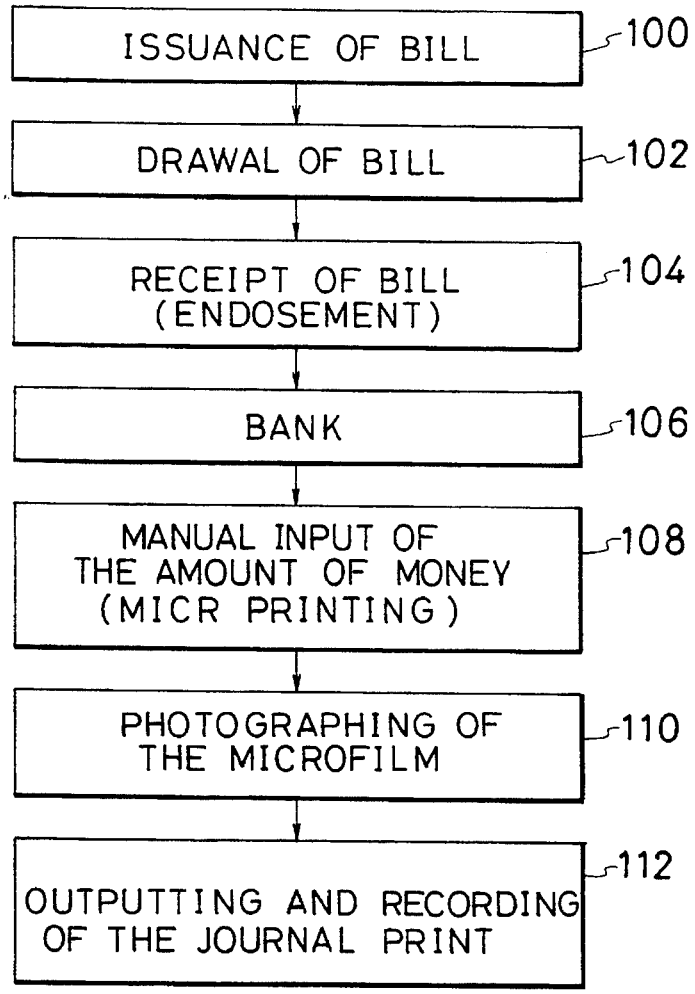
FIG.7 (PRIOR ART)
FIG. 7 is a flow chart showing the operation sequence for dealing addressed bills or checks.
Figure 8:
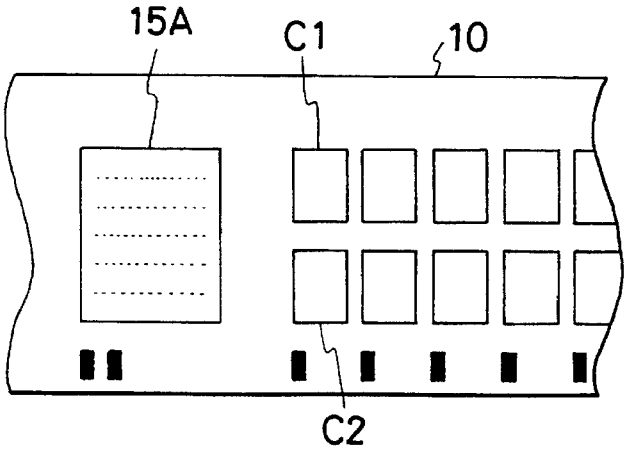
FIG. 8 is an illustration showing a part of the microfilm on which images of bills or checks are photographed together with a journal print.
Figure 9:
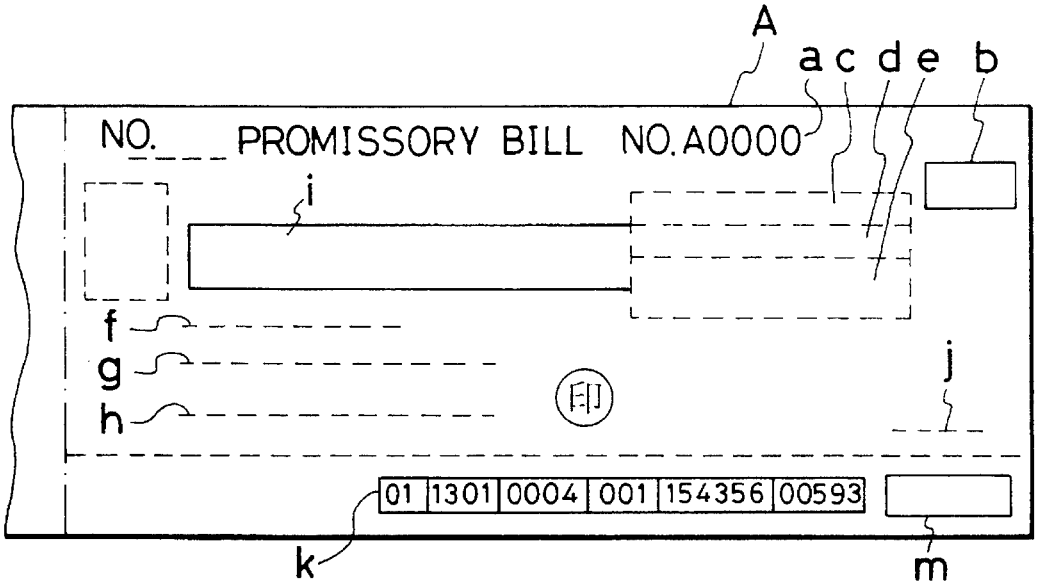
FIG. 9 is an illustration showing an example of an addressed bill before it is drawn.
Figure 10:
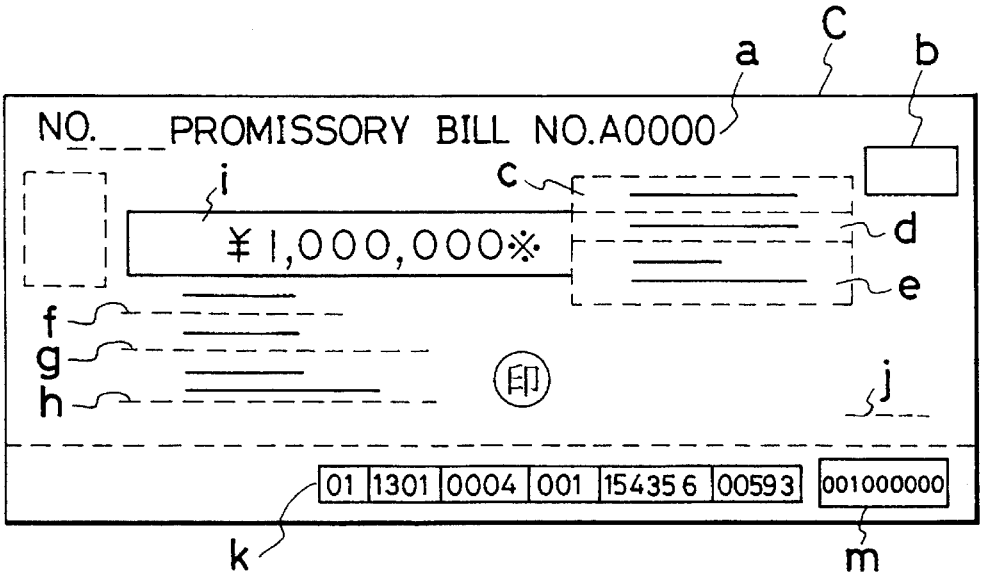
FIG. 10 is an illustration showing an example of an addressed bill after it is drawn.

The data including the data identifying the sort of individual bills and printed in the MICR printing column k see FIGS. 8 and 9) is read by the MICR reader 38 and fed to a sort discrimination section 46*b* of the controller 46 where the content of the data is discriminated and stored (Step 124 in FIG. 2). The amount of money read by the OCR 34 is printed by the MICR printer 40 in the MICR print column m (Step 126 in FIG. 2). The images of the obverse and reverse side of the bill B are photographed by the optical system 42 on the microfilm 50 (Step 128 in FIG. 2). The mechanism for feeding the film 50 is the same as shown in FIG. 6, and thus the parts thereof are denoted by same reference numerals and the description thereof will not be repeated. The additional rejecter 44 is provided to discharge bills B when jamming, overlapping or any other malfunction occurs in feeding of the bills B.

Reference numeral 48 designates recording means comprising, for example, an LED array and disposed beside the photographing roller 12. The recording means 48 receives the outputs from a totalization section 46*c* and the sort discrimination section 46*b* of the controller 46 to record the data identifying a group of bills and the data relating to the total amounts of money of the bills, similar to the journal print 15 (see FIG. 6) and the photographed image 15A (see FIG. 8) thereof (Step 130 in FIG. 2).

The bill B1 rejected by the rejecter 36 (Step 122) is read through the prior art system and the amount of money thereof is read and inputted by the operator (Step 132) to be photographed on a different microfilm 10 and the journal print 15 relating to rejected bills B1 is prepared and also photographed on the microfilm 10 (Step 134). The thus photographed microfilms 50, 10 are preserved as desired.

Figure 3:
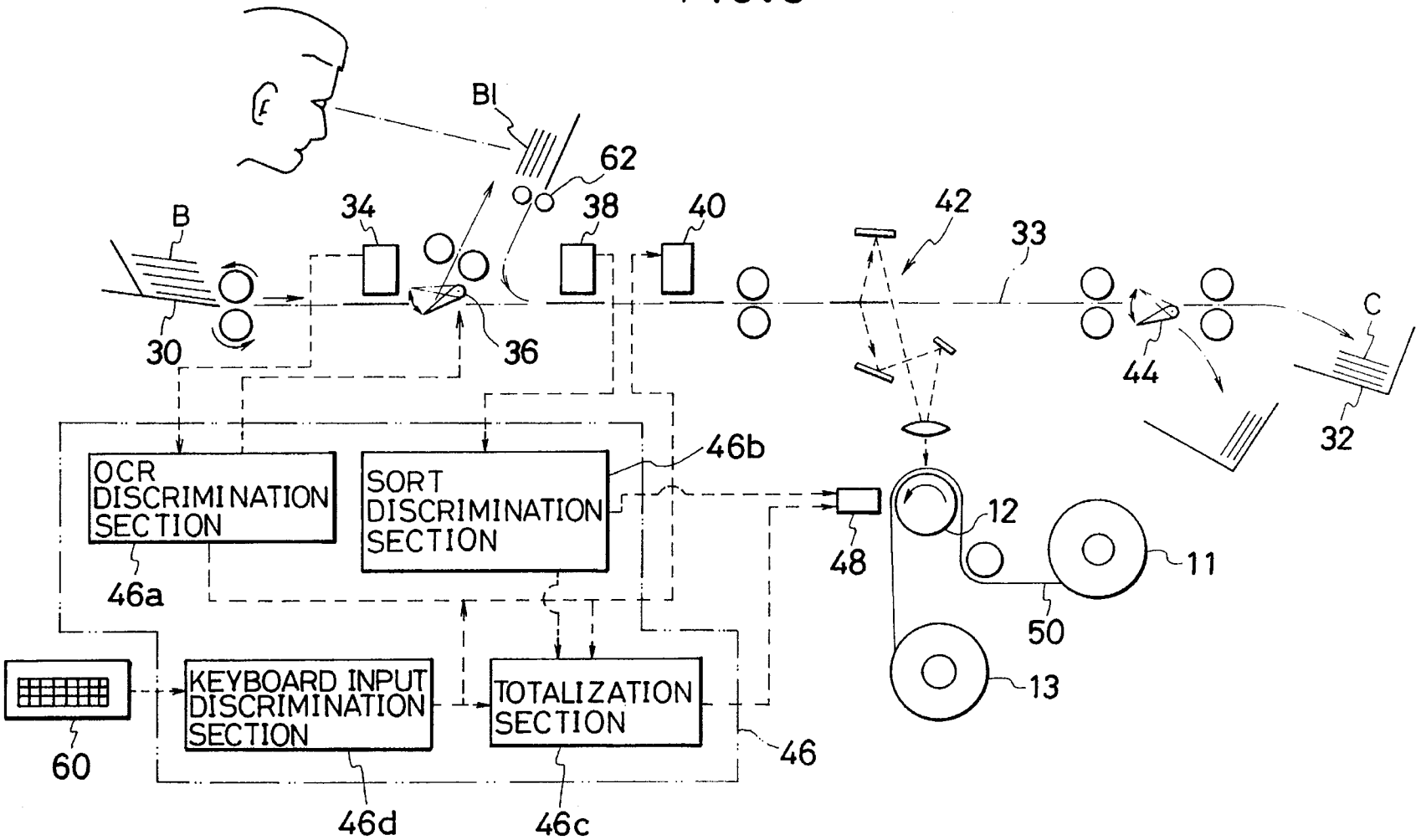
FIG. 3 is a diagrammatical view showing the construction of a second embodiment of the invention.

FIG. 3 shows the second embodiment. The second embodiment is provided with a keyboard 60 for inputting the amount of money of each of the rejected bills B1 which have been rejected and discharged by the rejecter 36. Conveyance of the bills B is stopped as a certain bill B1 is rejected, and the rejected bill B1 is returned back to the passage 33 after the data relating to the amount of money has been inputted through the keyboard 60. Reference numeral 62 designates a feeder for returning the bill B1 back to the passage 33.

Conveyance of bill is thus stopped as the bill B1 is discharged from the passage 33 until the amount of money of the bill B1 is inputted through the keyboard 60, and the data inputted through the keyboard 60 is discriminated by a keyboard input discrimination section 46*d* of the controller 46. The amount of money inputted through the keyboard is printed by the MICR printer 40 on the bill B1 returned back to the passage 33. The operation sequence is shown by the phantom line in FIG. 2. Alternatively, rejected bills B1 may be collected and collectively processed through the manual operation to be returned back to the passage 33 in lieu of stopping conveyance of bills at every time when individual bills B1 are rejected.

Figure 4:
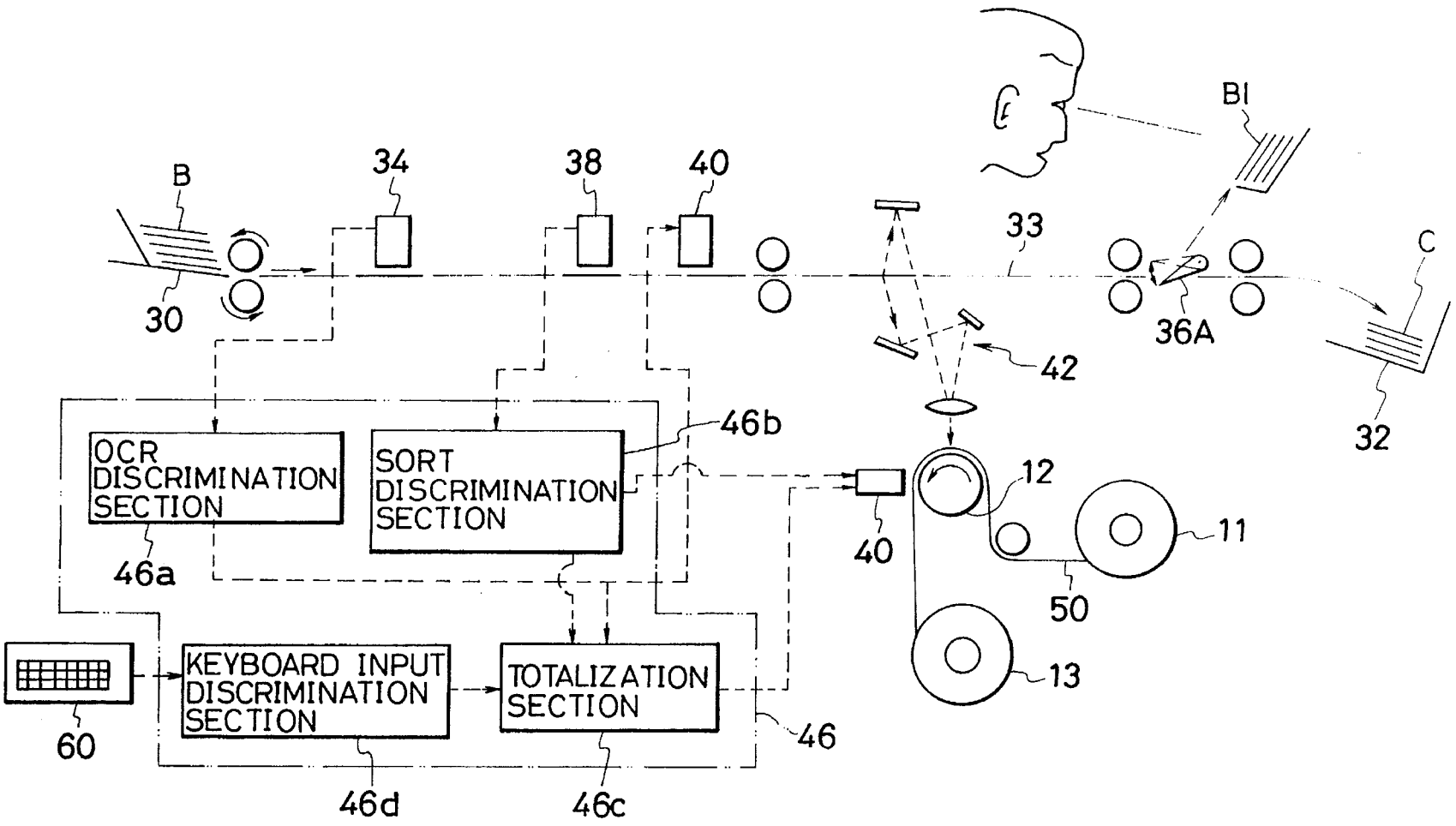
FIG. 4 is a diagrammatical view showing the construction of a third embodiment of the invention.

FIG. 4 shows the third embodiment. This third embodiment is provided with a rejector 36A for rejecting each bill B1, the amount of money of which cannot be read by the OCR 34, at a position downstream of the optical system 42. The image of such a bill B1 is photographed on the microfilm 50 while the MICR print column m is left blank. The amount of money of each rejected bills B1 is inputted through the keyboard 60 by manual operation to print the same in the MICR print column m, the information printed in the column m having not been recorded. However, the data of these rejected bills B1 are totalized with the data of the unrejected bills B, and the data is sorted and recorded by recording means 48. Differing from the prior art system, in the present invention there is no need of preparing the journal print 15 when the third embodiment of the invention is used, leading to improvement in operation efficiency.

Figure 5:
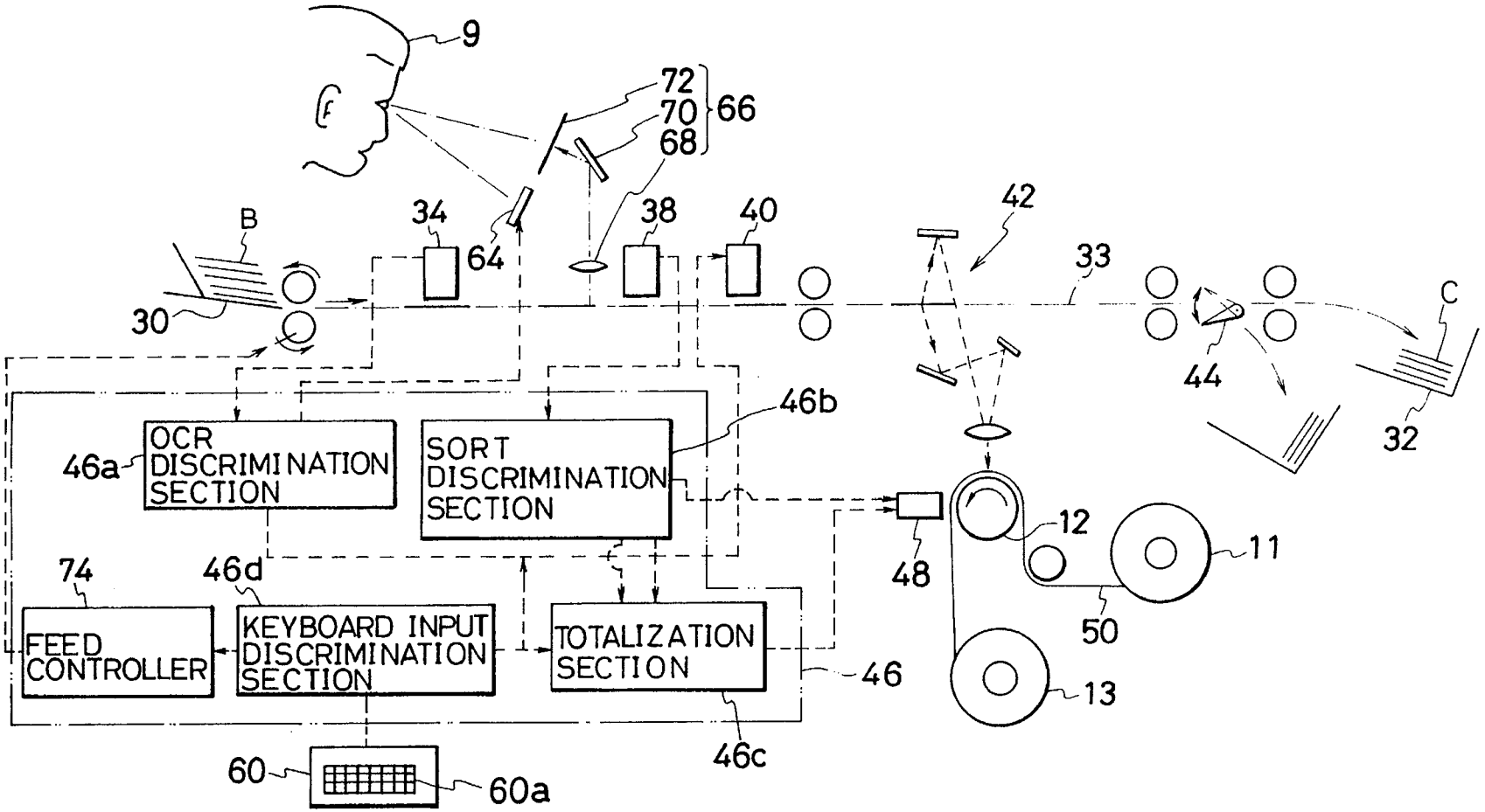
FIG. 5 is a diagrammatical view showing the construction of a fourth embodiment of the invention.

FIG. 5 shows the fourth embodiment. In the fourth embodiment, the information (the amount of money) read by the OCR from the column i, in which the amount of money is written, is displayed beside the image of the column i of the actual bill or check. Accordingly, it is made possible for the operator to confirm that these two amounts are identical with each other.

In FIG. 5, reference numeral 64 designates display means made of, for example, a liquid crystal display plate for displaying the amount of money. The information obtained by reading the column i by the OCR 34, followed by discrimination by an OCR discrimination section 46*a*, is displayed on the display means 64.

Reference numeral 66 designates display means for displaying the amount of money in the column i of the bill or check which is the same bill or check, the amount of money of which is now read by the OCR 34 and displayed on the display means 64. The display means 66 comprises a projector lens 68 for projecting the image of the column i of the bill or check B, which is intermittently stopped after it is passed through the OCR, a reflector mirror 70 and a display section 72 which may be a screen or like display means.

Alternatively, the display means 66 may comprises an image sensor for reading the image in the column i, and a liquid crystal display means for displaying the sensed image. The display section of the display means 66 is disposed close to the display means 64 so that the operator 9 can compare the displayed amounts easily.

Reference numeral 74 designates a feed controller which controls intermittent supply of bills or checks to the passage 33 in response to the operation of pushing a confirmation key 60*a* contained in the keyborad 60. Since those parts which are the same as those shown in FIG. 4 are denoted by same reference numerals in FIG. 5, the description thereof will not be repeated.

With the use of this embodiment, the amount of money written in the column i of each bill or check B is read and displayed on the display means 64. Then, the bill or check B is fed below the projector lens 68 and stopped in position, and the image in the column i is displayed on the display section 72 of the display means 66. The operator 9 reads the displayed image indicating the amount of money on the display section 72, and compares this with the amount of money read by the OCR 34 and displayed on the display means 64.

When the amount of money displayed on the display section 72 is identical with the amount of money displayed on the display means 64, the operator 9 pushes the confirmation key 60*a* to feed the bill or check B to initiate dealing of the next bill or check B. When the result of comparison shows that the displayed amounts of money are not identical with each other, the operator inputs the correct amount of money through the keyboard 60 so that the correct amount of money is printed by the MICR printer 40.

Alternatively, in case where the displayed amounts of money are not identical with each other, the bill or check B may be rejected and discharged from the passage 33 and the rejected bills or checks B may be collectively dealt through a separate operation sequence.

In a modification of the embodiment of FIG. 5, the amount of money written the bill or check B is observed directly by the eyes of the operator 9 in lieu of the provision of the projector lens 68, reflector mirror 70 and display section 72. In a further modification of the embodiment of FIG. 5, the rejecter 36 shown in FIG. 3 may be provided. In such a modification, the bills or checks B, the amounts of money of which are not discriminated by the OCR discrimination section 46*a*, are rejected and the thus rejected bills or checks B are collected and then collectively with by inputting the amounts of money thereof through the keyboard 60.

Alarm means for calling attention of the operator 9 when the amount of money is not discriminated by the OCR discrimination section 46*a* may be provided. Examples of such alarm means include a sound alram system, or a system for flashing the display on the display means 64 or for changing the color of the displayed image.

As will be seen from the foregoing, since the amount of money written on each bill or check is read by the OCR and printed in the MICR print column by the MICR printer, according to the present invention, there is no need of manual input operation by the operator leading to appreciable improvement in operation efficiency. Mistakes in input operation are diminished since the MICR printing is conducted automatically.

The bills or checks, the amounts of money of which are not read by the OCR, are rejected and the amounts of money are read by the operator and inputted through a keyboard. Rejection of such a bill or check may be effected intermediately of the OCR and the MICR printer, and the bill or check is returned back to the position of the passage from which it is rejected, whereby the bill or check is photographed on the microfilm with the amount of money being MICR printed. This embodiment is convenient when the totalization of amounts of money is conducted automatically and simultaneously with the recording of the bills or checks. The rejecter may be provided downstream of the optical system, and dealing of the bills or checks, the amounts of money of which are read by the OCR, are conducted successively while leaving the rejected bills or checks to be dealt with manually at a later time to improve the operation efficiency.

The data preliminarily MICR printed on respective bills or checks may be read by the MICR reader, and the information thus obtained may be collected, sorted and totalized to be recorded at the fore or aft end of the microfilm together with the result of totalization of the amounts of money.

The amount of money read by the OCR may be displayed close to the actual image in the column for writing the amount of money, so that the operator can compare the amount of money read by the OCR with the amount of money written by the drawer of the bill or check, whereby mistake in reading by the OCR are prevented.

What is claimed is:

1. A microfilm camera for reading an amount of money of an addressed bill or check brought into a bank, said amount of money being written in a column for writing said amount of money by a drawer of said addressed bill or check, for printing said amount of money for magnetic ink character recognition (MICR) and for photographing an image of said addressed bill or check on a microfilm, comprising:

an optical character reader (OCR) for reading said amount of money written by said drawer, an MICR printer disposed downstream of said OCR for printing said amount of money read by said OCR, and an optical system for photographing said image of said addressed bill or check on said microfilm after said addressed bill or check is printed for MICR by said MICR printer.

2. The microfilm camera of claim 1, further comprising:

rejecting means for rejecting to discharge said addressed bill or check when said amount of money cannot be read by said OCR, and a keyboard for inputting said amount of money of said rejected addressed bill or check by manual operation.

3. The microfilm camera of claim 2, wherein said rejecting means is disposed between said OCR and said MICR printer and wherein said rejected addressed bill or check is returned back to a position between said OCR and said MICR printer after said amount of money has been inputted through said keyboard by said manual operation.

4. The microfilm camera of claim 2, wherein said rejecting means is disposed downstream of said optical system so that said rejected addressed bill or check is printed for MICR after said image has been photographed by said optical system.

5. The microfilm camera of claim 1, further comprising an MICR reader disposed downstream of said OCR for reading classifying data of said addressed bill or check, said classification data being preliminarily printed for MICR, a controller for classifying and totalizing plural addressed bills or checks by referring to outputs from said OCR and said MICR reader, and recording means for recording a result of classification and totalization on said microfilm.

6. The microfilm camera of claim 2, further comprising an MICR reader disposed downstream of said OCR for reading classification data of said addressed bill or check, said classification data being preliminarily printed for MICR, a controller for and totalizing plural addressed bills or checks by referring to outputs from said OCR and said MICR reader, and recording means for recording a result of classification and totalization on said microfilm.

7. The microfilm camera of claim 3, further comprising an MICR reader disposed downstream of said OCR for reading classification data of said addressed bill or check, said classification data being preliminarily printed for MICR, a controller for classifying and totalizing plural addressed bills or checks by referring to outputs from said OCR and said MICR reader, and recording means for recording a result of classification and totalization on said microfilm.

8. The microfilm camera of claim 4, further comprising an MICR reader disposed downstream of said OCR for reading classification data of said addressed bill or check, said classification data being preliminarily printed for MICR, a controller for classifying and totalizing plural addressed bills or checks by referring to outputs from said OCR and said MICR reader, and recording means for recording a result of classification and totalization on said microfilm.

9. The microfilm camera of claim 1, further comprising first display means for displaying an image of said amount of money read by said OCR, second display means for displaying said column, in which the amount of money is written, of said addressed bill or check at a position close to said displayed image displayed by said first display means, and feed control means for intermittently feeding addressed bills or checks in response to instructions fed through an instruction key.

10. A microfilm camera for reading an amount of money of an addressed bill or check brought into a bank, said amount of money being written in a column for writing said amount of money by a drawer of said addressed bill or check, for printing said amount of money for magnetic ink character recognition (MICR) and for photographing an image of said addressed bill or check on microfilm, comprising:

an optical character reader (OCR) for reading said amount of money written by said drawer, an MICR printer disposed downstream of said OCR for printing said amount of money read by said OCR, an optical system for photographing said image of said addressed bill or check on said microfilm after said addressed bill or check is printed for MICR by said MICR printer, rejecting means for rejecting to discharge said addressed bill or check when said amount of money cannot be read by said OCR, and a keyboard for inputting said amount of money of said rejected addressed bill or check by manual operation, wherein said rejecting means is disposed downstream of said optical system so that said rejected addressed bill or check is printed for MICR after said image has been photographed by said optical system.

11. The microfilm camera of claim 10, further comprising an MICR reader disposed downstream of said OCR for reading classification data of said addressed bill or check, said classification data being preliminarily printed for MICR, a controller for classifying and totalizing plural addressed bills or checks by referring to outputs from said OCR and said MICR reader, and recording means for recording a result of classification and totalization data on said microfilm.

* * * * *